US007210230B2

(12) United States Patent
Wurzel

(10) Patent No.: US 7,210,230 B2
(45) Date of Patent: May 1, 2007

(54) CUTICLE CUTTER

(75) Inventor: Paulo Roberto Wurzel, Cachoeirinha (BR)

(73) Assignee: Zivi S/A Cutelaria, Porto Alegres (BR)

( * ) Notice: Subject to any disclaimer, the term of this patent is extended or adjusted under 35 U.S.C. 154(b) by 9 days.

(21) Appl. No.: 10/522,531

(22) PCT Filed: Jul. 10, 2003

(86) PCT No.: PCT/BR03/00091

§ 371 (c)(1),
(2), (4) Date: Oct. 12, 2005

(87) PCT Pub. No.: WO2004/010819

PCT Pub. Date: Feb. 5, 2004

(65) Prior Publication Data

US 2006/0085988 A1 Apr. 27, 2006

(30) Foreign Application Priority Data

Jul. 29, 2002 (BR) ..... 8201678 U

(51) Int. Cl.
*A45D 29/00* (2006.01)
*B26B 13/04* (2006.01)

(52) U.S. Cl. ..... 30/260; 30/26; 30/29; 30/146

(58) Field of Classification Search ..... 30/260, 30/261, 26, 27, 29, 142, 145, 146; 81/345, 81/407

See application file for complete search history.

(56) References Cited

U.S. PATENT DOCUMENTS 869,946 A * 11/1907 Tolman ..... 132/75.5
1,427,898 A * 9/1922 Himelfarb ..... 30/278
2,192,725 A * 3/1940 Williams ..... 30/255
2,745,177 A * 5/1956 Kortick ..... 30/186
4,074,597 A * 2/1978 Jansson ..... 81/417
4,407,069 A * 10/1983 Conners ..... 30/254
5,203,084 A * 4/1993 Kuo ..... 30/135
5,430,941 A * 7/1995 Lin ..... 30/260

FOREIGN PATENT DOCUMENTS

DE 36 03 487 C1 8/1987
FR 2 813 033 2/2002

* cited by examiner

*Primary Examiner*—Kenneth E. Peterson
*Assistant Examiner*—Sean Michalski
(74) *Attorney, Agent, or Firm*—Finnegan, Henderson, Farabow, Garrett & Dunner, L.L.P.

(57) ABSTRACT

A cuticle cutter of the like is described which is of the scissors type. Instruments of this type, especially in beauty salons, require constant cleaning, sharpening and sterilisation. The cutter of the invention facilitates such procedures by permitting the handles (2, 21) to be separate from the blades (1, 1'). In the preferred embodiment the blades are snap fitted into the handles and the arrangement is such that on opening the cutters to a maximum surfaces on the handles enter into abutment with the blades in the region of the pivot (6) and further opening cams the blades away from the handles, releasing them without any necessity for manual contact. The blades can then be submitted to the above mentioned procedures and stored for further use.

2 Claims, 3 Drawing Sheets

CUTICLE CUTTER

The present invention refers to a cuticle cutter of the scissors type.

STATE OF THE ART

Conventional cuticle cutters of the scissors type are presented to the user as undismountable relatively small instruments and when it is necessary to sharpen the cutter blades or carry out any other form of maintenance, which is relatively common, it is necessary to send them to a qualified professional, which is expensive and time consuming, or merely throw them away and buy a new device. This is obviously a disadvantage.

In addition, in beauty salons it is necessary to carry out complete cleaning and/or sterilisation of the cutters between use and this with time damages the handle parts of the devices. Since the cutter blades and not the handles enter into contact with the customer (user), such deep cleaning or sterilisation of the handles is not necessary.

Also in beauty salons, storage of cutters as complete instruments is difficult due to their complicated shape and there is a considerable risk that the cutting edges become damaged and/or that the handles themselves, especially when made of plastic material, may be damaged by the cutter blades. In addition to this, if the cutting edges are damages or worn beyond recuperation, the whole instrument has to be thrown away even though the handles might still be in a perfect state.

SUMMARY OF THE PRESENT INVENTION

According to the present invention the above problems can be entirely overcome by means of a scissors-type cuticle cutter or the like comprising a first cutter blade and handle combination pivoted to a second cutter blade and handle combination by means of a pivot element, in which the cutter blade and the handle of each combination are releasably attached to each other.

In the presently preferred embodiment of the invention in which each cutter blade consists of a cutting end, a central pivot portion through which said pivot element passes and a spigot, each handle is formed with a substantially longitudinal passage into which the spigot of the associated cutter blade is received and resilient releasable attachment means are provided to maintain the spigot in the passage.

It is preferred that each attachment means comprises a spring element formed with a protuberance mounted laterally in said passage and a lateral recess formed in the spigot of the respective cutter blade. The lateral recess receives the protuberance to maintain the cuticle cutter in a mounted configuration and the spring element may be flexed to permit separation of the cutter blade from the handle on the application of a longitudinal separating force between the handle and the cutter blade.

It is particularly desirable that the separation of the blades from the handles is effected simply and safely. In the preferred embodiment each said handle has an axially extending outer portion which, in the mounted configuration of the cuticle cutter, extends as far as said central pivot portions of the cutter blades. With this arrangement, on opening the cutter to a maximum extent, a laterally outer surface of each cutter blade may engage an inner surface of the axially extending outer portion of the handle associated with the other cutter blade to produce the longitudinal separating force between the blades and their associated handles.

SHORT DESCRIPTION OF THE DRAWINGS

The present invention will be better understood from the following specific description, given by way of example, of the presently preferred embodiment, reference being made to the accompanying drawings, in which.

SPECIFIC DESCRIPTION OF THE PREFERRED EMBODIMENT

Figure 1:
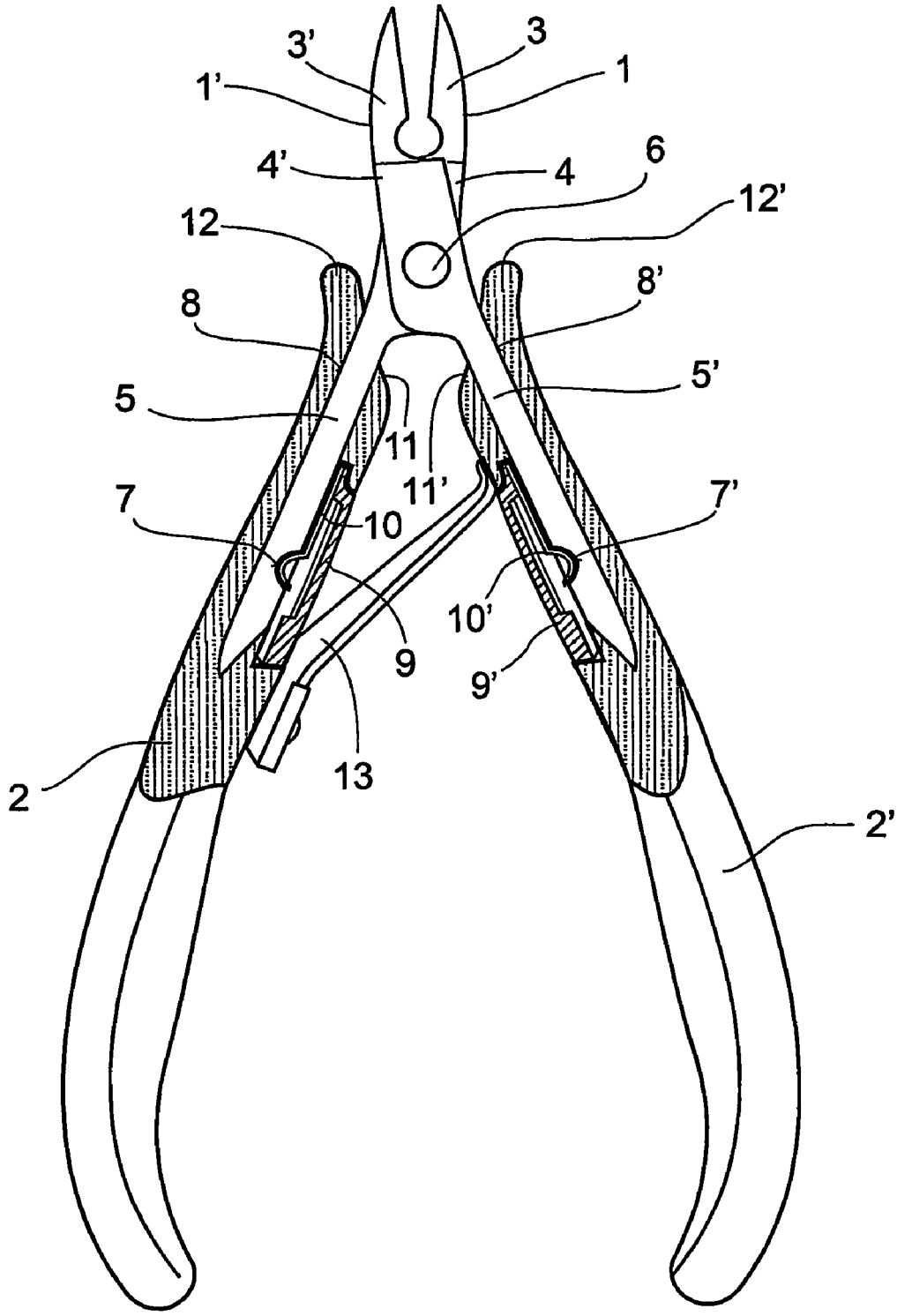
FIG. 1 is a side view of the presently preferred embodiment of a cuticle cutter according to the present invention, with the cutter in a cutting position (half open) and with the handles in longitudinal section so as to permit visualisation of the interconnection between the blades and the handles.

Referring now to the drawings, FIG. 1 shows a view of the preferred embodiment of a cuticle cutter in accordance with the present invention. As can be seen, the cutter comprises two blade-handle combinations comprising metal cutter blades 1 and 1' and plastic handles 2 and 2'. Cutter blade 1 comprises a blade end 3, a pivot portion 4 and a spigot 5. Similarly, cutter blade 1' comprises a blade end 3', a pivot portion 4' and a spigot 5'. The pivot portions 4 and 4' of the blades 1 and 1' are pivoted by means of a pivot element 6 in the form of a screw or rivet. It will be observed that each spigot 5 or 5' is formed with a lateral semicircular recess 7 or 7'.

Handles 2 and 2' are formed with longitudinal passageways 8 and 8' that are adapted to receive the spigot or handle ends 5 and 5' of the blades. Each handle 2 or 2' has a lateral opening providing access to the respective passageway 8 or 8' and is provided with a shaped plug 9 or 9' so that in normal use the plug can be snap fitted into and to close the opening. Each handle is also provided with a spring element 10 or 10' designed to fit into the cavity formed in the lateral opening. The spring elements 10 and 10' are basically flat strips of spring metal or the lake with a respective semicircular protuberances corresponding to the recesses 7 and 7' in the blade spigots 5 and 5'.

Each handle 2 or 2' at its blade end is provided with an inwardly inclined end surface 11 or 11', the passageway 8 or 8' being bored into such surface. The laterally outer side of the blade end of each handle 2 or 2', however, is formed with an extension 12 or 12' that, in the assembled configuration of the cutter as shown in FIG. 1, extends to a point approximately opposite the pivot element 6 of the blades.

Figure 3:
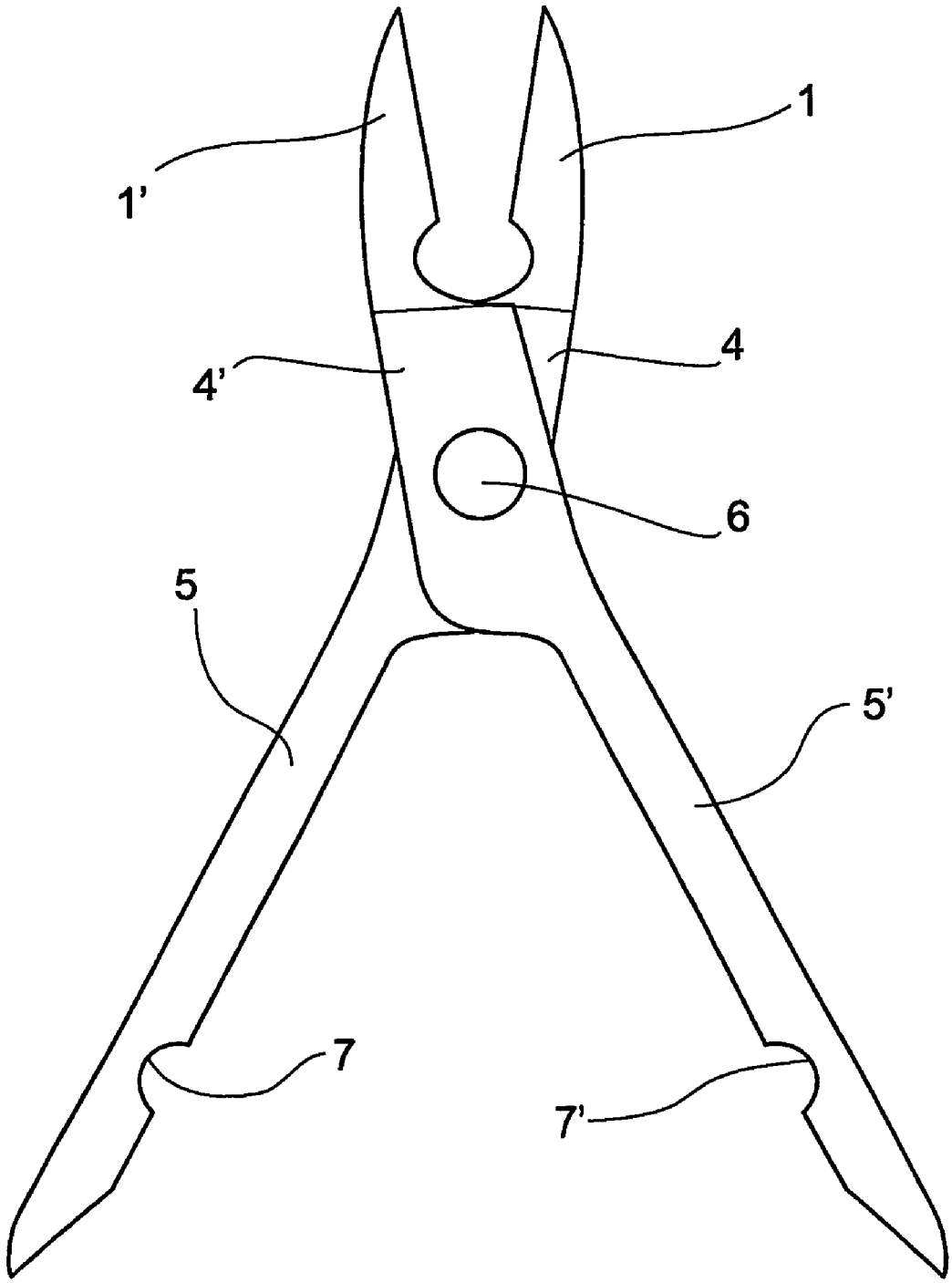
FIG. 3 is a view of the blades pivoted to each other, after removal.

In order to effect initial assembly of the cuticle cutter shown in FIG. 1, the spring elements 10 and 10' are placed in the cavities formed behind the lateral openings in the handles 2 and 2', after which the plug elements are snapped into place. The handles 2 and 2' are then fitted to the blade arrangement (see FIG. 3) by inserting the spigots 5 and 5' into the respective passageways 8 and 8' and manually pressuring them longitudinally until the semicircular protuberances of spring elements 10 and 10' enter the lateral recesses 7 and 7' in the spigots, firmly retaining them in place.

The cuticle cutter can then be used normally, a conventional spring element 13 mounted on handle 2 providing resistance during trimming.

Figure 2:
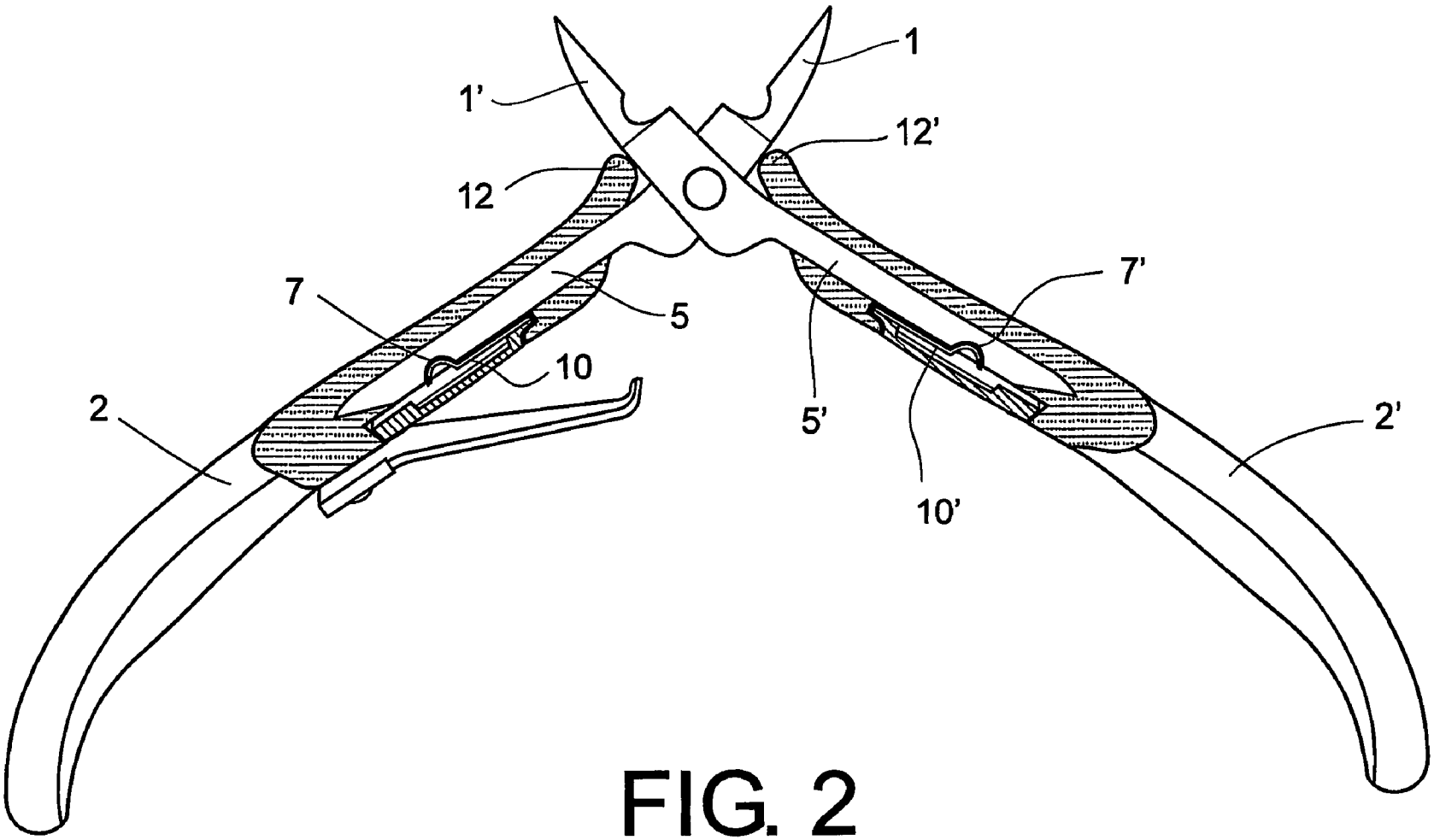
FIG. 2 is a view similar to that of FIG. 1, but with the cutter fully open to a point where separation of the blades from the handles is effected.

When it is desired to clean the blades, between users, it is sufficient to open the cutters to the maximum (see FIG. 2)

until the extensions 12 and 12' abut the laterally outer sides of the pivot portions 4 of the blades. Further forcible opening of the cutter results in a longitudinal separating force being applied to the blades with the result that the spigots 5 and 5' are pulled outwardly until engagement between the semicircular protuberances of spring elements 10 and 10' and the recesses 7 and 7' is lost. The blades can then be easily removed without any manual force and submitted to sterilisation and/or sharpening procedures. They can then be stored prior to further use.

It should be noted that no manual contact with the blades is necessary in order to release them from the handles, physical contact only being required to remove then to the location where they are to be cleaned or sterilised. Alternatively, if the blades are too worn or damaged for further use, they may be substituted for new ones without having also to throw away the respective handles.

The invention claimed is:

1. Cuticle cutter having the general configuration of scissors comprising:

a first cutter blade and handle combination;

a second cutter blade and handle combination pivoted to said first cutter blade and handle combination by means of a pivot element, each said cutter blade consists of a cutting end, a central pivot portion through which said pivot element passes and a spigot;

a substantially longitudinal passage in each said handle, into which the spigot of the respective first or second cutter blade is received; and resilient releasable attachment means being provided to retain each said spigot in said passage in its respective handle; characterised in that:

each said attachment means comprises a spring element (10; 10') formed with a protuberance mounted laterally in said passage and a lateral recess (7; 7') formed in said spigot 5; 5') of the respective cutter blade (1; 1'), said recess (7; 7') receiving the protuberance to maintain the cuticle cutter in a mounted configuration and said spring element (10; 10') being flexed to permit separation of the cutter blade from the handle (2; 2') on the application of a longitudinal separating force between the handle and the cutter blade; and each said handle (2; 2') has an axially extending outer portion (12; 12') which, in the mounted configuration of the cuticle cutter, extends as far as said central pivot portions of said cutter blades 1; 1') whereby, on opening said cuticle cutter to a maximum extent, a laterally outer surface of each cutter blade engages said axially extending outer portion (12; 12') of the handle associated with the other of said cutter blades to produce said longitudinal separating force between said cutter blades and their associated handles.

2. Cuticle cutter according to claim 1, characterised in that each said handle (2; 2') is formed with a lateral opening providing access to its longitudinal passage (8; 8') to permit insertion of said spring element (10; 10'), a snap fitting plug element (9; 9') closing said opening once the spring element is inserted.

* * * * *